United States Patent [19]

Balas et al.

[11] 4,066,263

[45] Jan. 3, 1978

[54] APPARATUS FOR PLAYING A GAME

[76] Inventors: Salman Heskel Balas, Little Linden, Montecute Gardens, Tunbridge Wells, Kent TN4 8HG; Clifton Quinton Keiller, Little Brook House, Ragged Dog Lane, Waldron, Sussex both of England

[21] Appl. No.: 686,904

[22] Filed: May 17, 1976

[30] Foreign Application Priority Data

July 21, 1975 United Kingdom ..... 30398/75

[51] Int. Cl.[2] ..... A63F 3/00

[52] U.S. Cl. ..... 273/273; 273/1 R; 273/120 R; 273/123 R; 273/281; 273/287

[58] Field of Search ..... 273/130 R, 131 B, 134 GA, 273/135 R, 135 B, 136 E, 139, 120 R, 123 R, 1 R, 124 R, 130 D

[56] References Cited

U.S. PATENT DOCUMENTS

| | | | |
|---|---|---|---|
| 1,491,520 | 4/1924 | Dailey | 273/135 R |
| 1,755,730 | 4/1930 | Gosser | 273/136 E |
| 3,181,867 | 5/1965 | Dreyer | 273/135 AC |
| 3,488,052 | 1/1970 | Weisbecker | 273/130 R |
| 3,501,151 | 3/1970 | Ketchum | 273/139 |
| 3,705,727 | 12/1972 | Breslow | 273/130 R |
| 3,888,487 | 6/1975 | Replogle | 273/130 B |

*Primary Examiner*—William H. Grieb
*Assistant Examiner*—Harry G. Strappello
*Attorney, Agent, or Firm*—Diller, Brown, Ramik & Wight

[57] ABSTRACT

Apparatus for playing a game including playing pieces and a playing device, the playing device including an upper board having spaced holes, a lower board spaced from the upper board, and playing piece supporting elements positioned between the upper and lower boards with the supporting elements being of a resilient or rigid nature.

9 Claims, 7 Drawing Figures

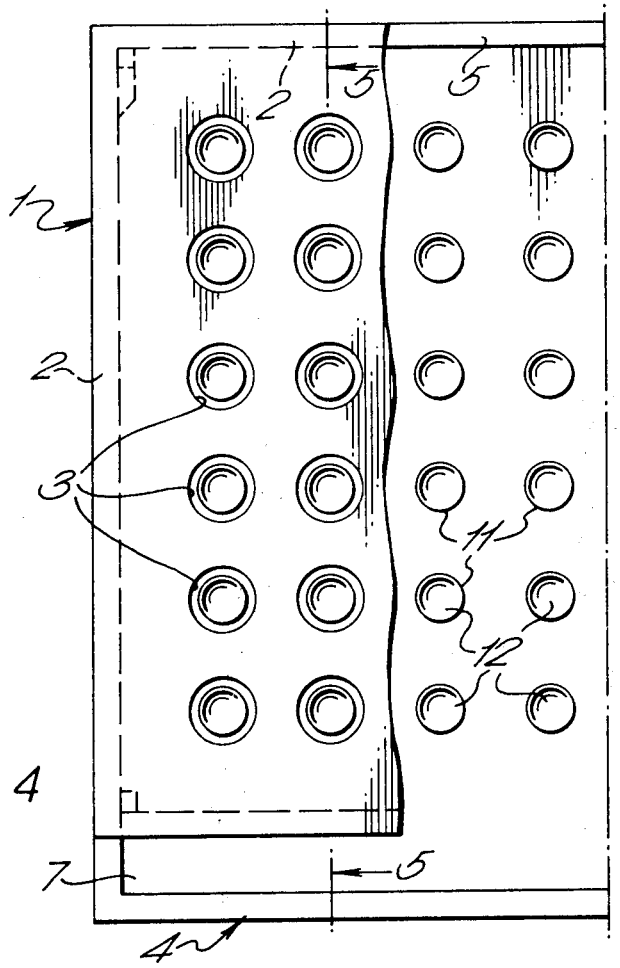
Fig. 4
Fig. 5
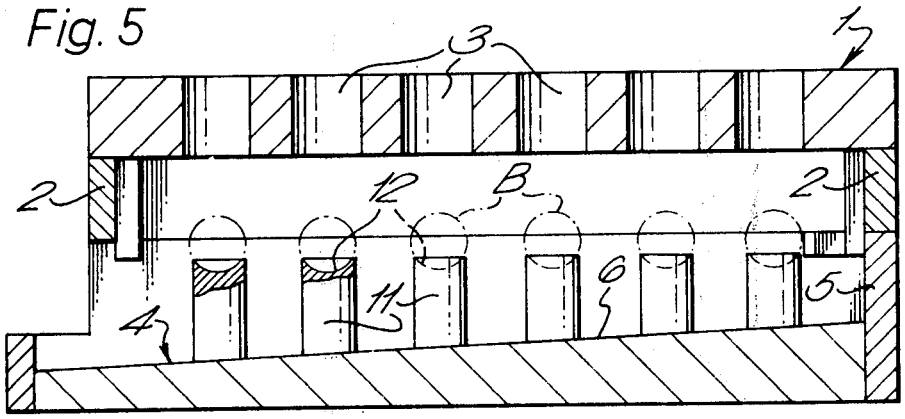

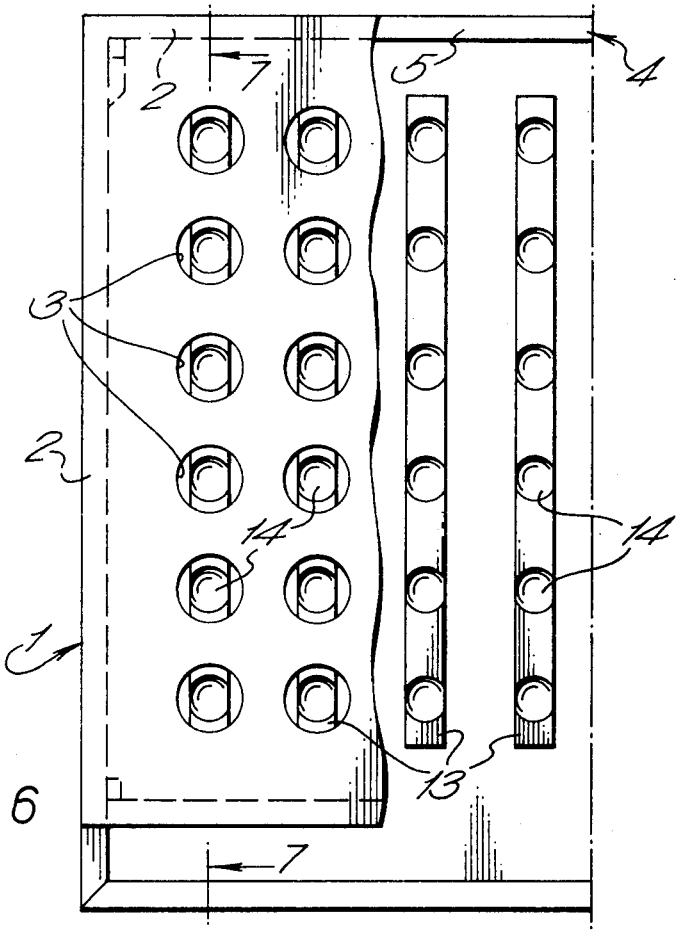
Fig. 6
Fig. 7
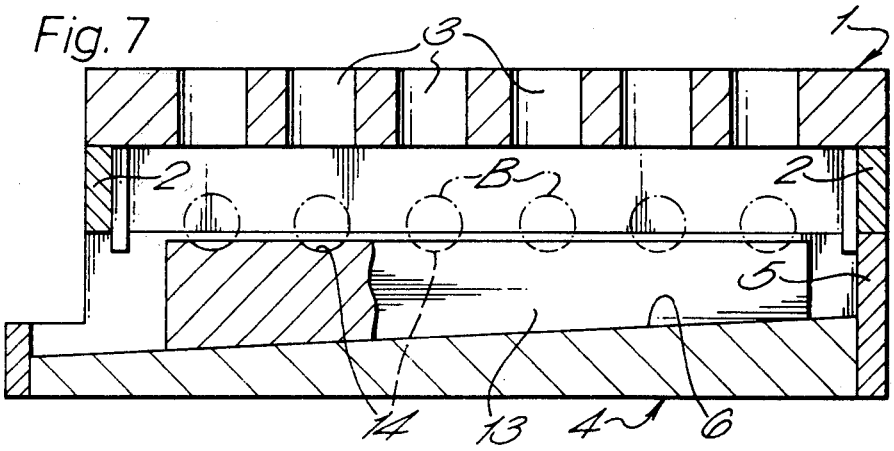

APPARATUS FOR PLAYING A GAME

This invention relates to apparatus for playing a game of skill and intellect which involves memorizing the positions of playing pieces and the moves made by other players.

It is among the objects of the present invention to provide apparatus for playing a game which is simple and relatively cheap to manufacture which, at the same time, provides an interesting and exciting game capable of being easily and quickly mastered by both young and old players.

According to the present invention, there is provided apparatus for playing a game comprising in combination a plurality of playing pieces and a playing device, the playing device having a upper board formed with a plurality of spaced openings, a lower board or playing piece collecting tray arranged below the upper board, and means arranged to support the playing pieces in a position between the upper and lower boards, and in positions corresponding to the openings in the upper board; wherein the relationship between the playing pieces and their supports is such that playing pieces can be dislodged individually from their supported positions whereby they fall onto the lower board or collecting tray.

Preferably, the playing pieces are in the form of balls, and the means for supporting the playing pieces may comprise resilient means or rigid means.

Figure 1:
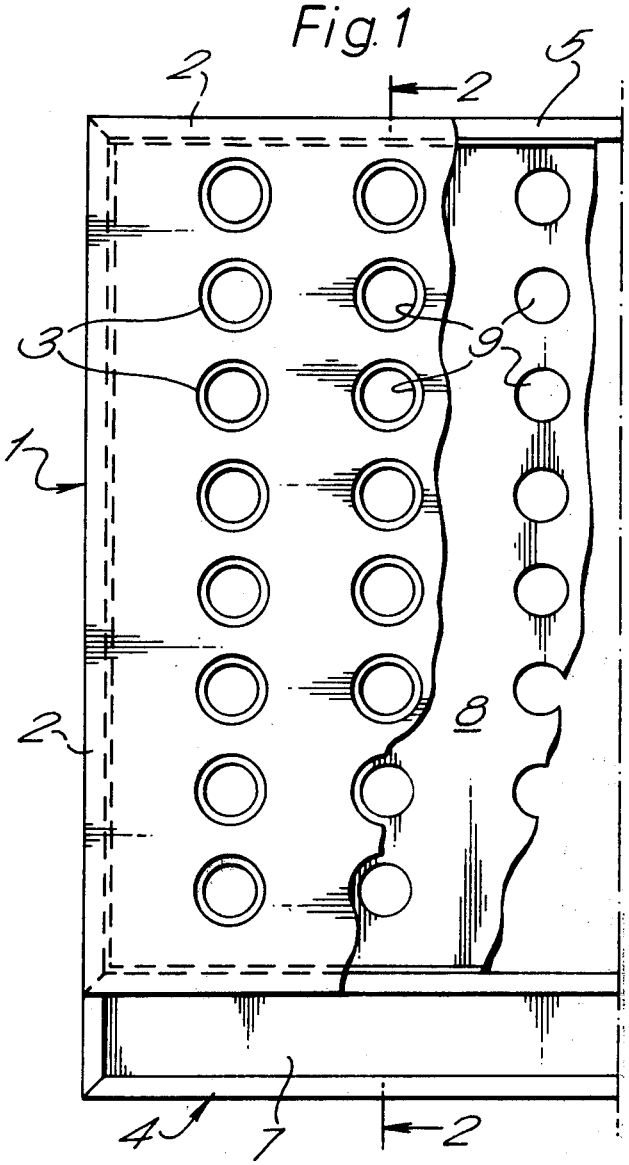
Figure 2:
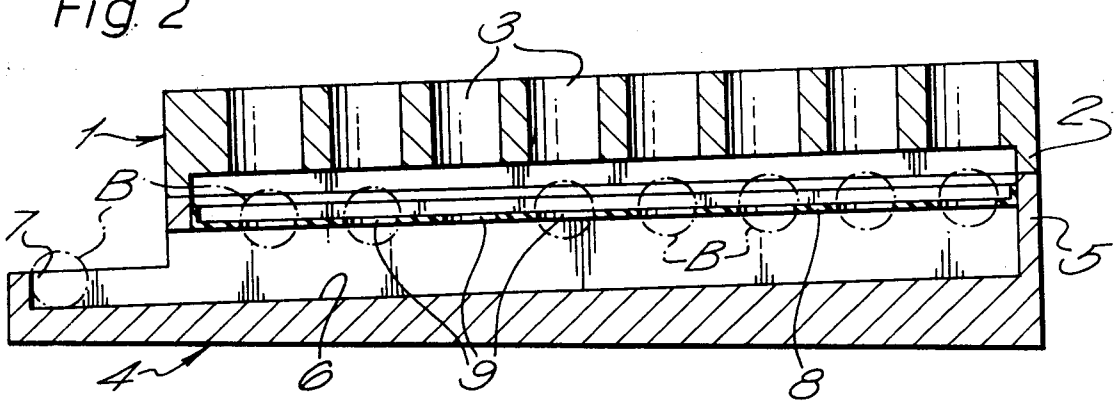
Figure 3:
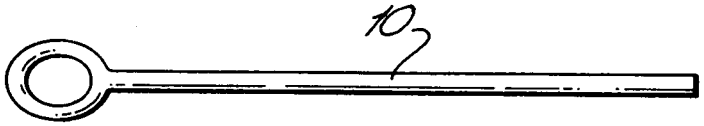

The invention is illustrated by way of example in the accompanying drawings in which, FIG. 1 is a half plan view (the other half being a mirror image thereof) of one form of playing device, FIG. 2 is a section on the line 2—2 of FIG. 1, FIG. 3 is an elevation of one form of means for dislodging the playing pieces from their supports within the device, FIG. 4 is a half plan view (the other half being a mirror image thereof) of another form of playing device, FIG. 5 is a section on the line 5—5 of FIG. 4, FIG. 6 is a half plan view (the other half being a mirror image thereof) of a still further form of playing device, and FIG. 7 is a section on the line 7—7 of FIG. 6.

Referring to FIGS. 1 to 3 of the drawings, a playing device comprises an upper board 1 having downwardly depending peripheral walls 2 and a plurality of spaced openings 3. The device further comprises a lower board or ball collecting tray 4 having upstanding peripheral walls 5 on which the walls 2 of the upper board 1 are supported. The upper surface 6, at least, of the lower board or tray 4 is inclined to the horizontal so that, when playing a game, playing pieces in the form of balls may roll down the surface 6 into a collecting channel 7 which projects outwardly from below the upper board.

Mounted below the upper board 1, and secured or supported in any convenient manner on the lower board or tray 4, are means for supporting the balls B in a position between the upper and lower boards 1 and 4. These means comprise one or more sheets 8 of a resilient material, such as rubber, having a plurality of spaced holes 9 which correspond to the positions of the holes 3 in the upper board 1. The size of the holes 9 is slightly smaller than the diameter of the balls B so that a ball can normally be supported by the peripheral edge of a hole.

If necessary, a rigid support may be provided below the resilient sheet or sheets 8 which has holes of larger diameter than the holes 9 so that an annulus of resilient material will overhang each hole in the rigid support.

The apparatus further includes a dislodging implement 10 as shown in FIG. 3 of the drawings.

In the alternative device shown in FIGS. 4 and 5 of the drawings, the general construction of the device is the same as that described with reference to FIGS. 1 to 3. This arrangement however has modified means for supporting the balls B. These means comprise a plurality of pedestals or columns 11 which project upwardly from the lower board or tray 4. These pedestals or columns 11 are in positions corresponding to those of the openings 3 in the upper board 1, and the upper surfaces 12 thereof are of concave formation to receive and support a ball B.

In the further alternative device shown in FIGS. 6 and 7 of the drawings, the general construction of the device is the same as that shown with reference to FIGS. 1 to 3. This arrangement however shows further modified means for supporting the balls B below the upper board 1. These means comprise support walls 13 which are aligned with separate rows of openings 3 in the upper board 1, each wall 13 being formed in its upper surface with indentations 14 to receive and support the balls B. The indentations 14 are provided in positions corresponding to the openings 3 in the board 1.

In each embodiment described, the upper and lower boards 1 and 4 may be hingedly interconnected along one side.

In playing a game, the upper board 1 is removed, or raised about its hinged connection, in order to expose the ball supporting means. The balls, which may be of different colours and/or have different markings to denote different values, are positioned by the players in or on the ball supporting means 8, 11 or 13 in random positions. The players may then be given a predetermined time in which to observe and memorize the positions of the balls. The upper board 1 is then replaced so that it obscures the positions of the balls. The players then take turns to dislodge the balls from their supported positions using the dislodging implement 10. Dislodged balls fall onto the inclined surface 6 and roll into the collecting channel 7 where they can be retrieved by the players. In the case of the embodiment of FIGS. 1 to 3, the balls are dislodged by forcing them through the holes 9, and in the case of the remaining embodiments, the balls are dislodged by knocking them sideways. Scoring is based on the number, or the value, of balls dislodged by each player.

Although the embodiment of FIGS. 4 and 5 has been described with reference to the ball supporting means being in the form of pedestals or columns, it will be obvious that it is not limited in this respect. Thus, the term pedestals includes within its scope any form of upstanding support having a cup-shaped upper surface to accommodate a ball.

Furthermore, although the invention has been described with reference to a dislodging implement 10, the device could be such that a player could use his finger for this purpose.

Also, with regard to the embodiments of FIGS. 4 and 5 and 6 and 7 of the drawings, although the invention has been described and illustrated with reference to the openings 3 being directly above the ball supporting means, it will be appreciated that these may be offset relative to one another to facilitate dislodgement of the balls.

In addition, with regard to the embodiment of FIGS. 1 to 3, although the invention has been described with reference to the ball supporting means taking the form of a resilient annulus, it will be understood that it is not limited in this respect. Thus, the sheet or sheets 8 of resilient material may be replaced by strips of resilient material or even spring wire arranged as one or more chords to openings formed in a rigid support in order to restrict the openings, the restriction being overcome, as hereinbefore described, by applying pressure to a supported ball by means of the dislodging implement 10, or by using a finger.

The embodiments shown are constructed of timber and the balls are marbles. However, it will be obvious that any suitable material, or combination of materials may be used such as a plastics material, metal or heavy cardboard.

We claim:

1. Apparatus for playing a game, comprising in combination a plurality of playing pieces and a playing device, said playing device having an upper board formed with a plurality of spaced openings, a lower board providing a playing piece collecting tray positioned below said upper board, and means arranged to support said playing pieces in a position between said upper and said lower boards and in positions corresponding to said openings in said upper board, wherein said playing piece supporting means comprises at least one sheet of resilient material having holes of a diameter which is slightly less than that of the diameter of said playing pieces, the relationship between said playing pieces and said playing piece supporting means being such that said playing pieces can be dislodged individually from their supported positions whereby they fall onto said lower board.

2. Apparatus for playing a game, comprising in combination a plurality of playing pieces and a playing device, said playing device having an upper board formed with a plurality of spaced openings, a lower board providing a playing piece collecting tray positioned below said upper board, and means arranged to support said playing pieces in a position between said upper and said lower boards and in positions corresponding to said openings in said upper board, wherein said playing piece supporting means comprise a plurality of pedestals projecting upwardly from said lower board, the upper surface of each of said pedestals being of concave formation, the relationship between said playing pieces and said playing piece supporting means being such that said playing pieces can be dislodged individually from their supported positions whereby they fall onto said lower board.

3. Apparatus for playing a game, comprising in combination a plurality of playing pieces and a playing device, said playing device having an upper board formed with a plurality of spaced openings, a lower board providing a playing piece collecting tray positioned below said upper board, and means arranged to support said playing pieces in a position between said upper and said lower boards and in positions corresponding to said openings in said upper board, wherein said playing piece supporting means comprise a plurality of spaced supporting walls projecting upwardly from said lower board, the upper surfaces of said supporting walls each having spaced indentations to receive a playing piece which corresponds to the positions of said openings in said upper board, the relationship between said playing pieces and said playing piece supporting means being such that said playing pieces can be dislodged individually from their supported positions whereby they fall onto said lower board.

4. Apparatus as claimed in claim 1 wherein the upper surface of said lower board is inclined to the horizontal and co-acts with a playing piece collecting channel.

5. Apparatus as claimed in claim 1 including playing piece dislodging means in the form of a stick-like element.

6. Apparatus as claimed in claim 2, in which the upper surface of said lower board is inclined to the horizontal and co-acts with a playing piece collecting channel.

7. Apparatus as claimed in claim 2, including playing piece dislodging means in the form of a stick-like element.

8. Apparatus as claimed in claim 3, in which the upper surface of said lower board is inclined to the horizontal and co-acts with a playing piece collecting channel.

9. Apparatus as claimed in claim 3, including playing piece dislodging means in the form of a stick-like element.

* * * * *